United States Patent [19]

Matkan

[11] Patent Number: 5,030,530

[45] Date of Patent: Jul. 9, 1991

[54] METHOD OF ELECTROSTATIC COLOR PROOFING

[76] Inventor: Josef Matkan, 56 Sheffield Street, Malvern, Australia, 5061

[21] Appl. No.: 920,847

[22] Filed: Oct. 17, 1986

[30] Foreign Application Priority Data

Oct. 31, 1985 [AU] Australia ..... PH03192

[51] Int. Cl.[5] ..... G03G 13/01

[52] U.S. Cl. ..... 430/45; 430/100

[58] Field of Search ..... 430/100, 126, 45

[56] References Cited

U.S. PATENT DOCUMENTS

| | | | |
|---|---|---|---|
| 3,041,169 | 6/1962 | Wielicki | 430/101 |
| 3,216,844 | 11/1965 | King | 430/101 |
| 3,384,488 | 5/1968 | Tulagin | 430/101 |

*Primary Examiner*—John Goodrow

[57] ABSTRACT

A method of producing positive multicolor proofs electrostetically including the steps of charging a photoconductor, exposing the charged photoconductor to a negative film, forming a latent electrostatic image on the photoconductor, transfer toning said latent image by virtual contact with a donor member carrying an electrostaticially deposited toner layer. The image remaining on the donor member is transferred to the printing stock paper forming the positive proof. Multiple images are formed from successive film negatives and transferred successively on the printing stock.

The deposited form layer is split, between the charged areas on the photoconductor and the image areas on the donor member.

10 Claims, 1 Drawing Sheet

METHOD OF ELECTROSTATIC COLOR PROOFING

BACKGROUND OF THE INVENTION

This invention relates to electrophotography and in particular to a novel method of preparing by an electrophotographic process multicolor pre-press proofs from negative color separation films.

The purpose of pre-press proofs as is well known in the art is to assess color balance and strength which can be expected from the final press run and accordingly to correct the separation transparencies before the printing plates are made therefrom In many instances it is also required to produce so-called customer proofs for approval of subject, composition and general appearance of the print prior to press run. Thus it is essential that the pre-press proof should have the same appearance as the press print, that is to say in addition to matching the colors of the press print, the pre-press proof should be on the same paper as the press print.

On the basis of the pre-press proofs the color separation transparencies are accepted or corrected if found necessary and then used for the preparation of printing plates. There are so-called positive working and negative working printing plates, as is well known in the art. A positive working printing plate is exposed to a positive transparency or film positive wherein the information to be printed corresponds directly to opaque areas whereas the non-printing background areas correspond to transparent areas contained on such film positive. By exposing to light through a film positive such positive working plate the exposed areas contained thereon are rendered removable by chemical treatment and the underlying usually grained aluminium plate surface forms then the water receptive non-printing or non-image areas whereas the unexposed areas contained thereon form the ink receptive printing or image areas during the subsequent lithographic or offset printing. A negative working printing plate is exposed to light through a film negative wherein the information to be printed corresponds to transparent areas whereas the non-printing background areas correspond to opaque areas contained on such film negative. In this case the exposed areas become photo-hardened and form the ink receptive printing areas whereas the unexposed areas are removed by chemical treatment and the underlying water receptive usually grained aluminium plate surface forms the non-printing or non-image areas during subsequent lithographic or offset printing.

It is known to produce by electrophotographic processes lithographic and gravure pre-press proofs containing in general four colors, such as yellow, magenta, cyan and black. Such pre-press proofing processes are disclosed for instance in U.S. Pat. Nos. 3,337,340, 3,419,411 and 3,862,848.

It is customary to produce such electrophotographic pre-press proofs by charging a photoconductive recording member followed by exposure through a separation film positive corresponding to one color, followed by toning of the exposed photoconductor with a liquid dispersed toner of the appropriate color, followed by in-register transfer of the color toned image deposit to a receiving member surface, such as paper, usually of the same grade as the printing stock. These process steps are then repeated with separation film positives of the other three or more colors and appropriate color toners to produce a multi-color pre-press proof of print as required.

It should be noted that all prior art electrophotographic pre-press proofing processes are so-called direct reproduction processes that is to say the color separation transparencies employed comprise film positives wherein the image areas to be reproduced correspond directly to the opaque image areas on such film positives. Consequently in such prior art electrophotographic pre-press proofing processes the latent image formed on the photoconductor upon exposure to such positive separation films is developed by attracting thereto liquid toner material of opposite polarity to that of the electrostatic charges constituting said latent images whereby the so formed toner deposits on the photoconductor surface correspond directly to the image areas to be reproduced. Thus prior art electrophotographic pre-press proofing processes are employed only for proofing of film positives which are used for the preparation of positive working printing plates.

Prior art electrophotographic pre-press proofing processes are not suitable for the proofing of film negatives used for the preparation of negative working printing plates that is to say such processes are not suitable for the reversal reproduction of imagery wherein the transparent areas contained on a film negative are to be reproduced as the image areas on the pre-press proof. Reversal reproduction per se by electrophotography is well known in the art but the processes employed for this purpose are not suitable for multicolor pre-press proofing.

Reversal image reproduction in electrophotography is normally carried out according to prior art practices by means of so-called repulsion toning. This process comprises the steps of electrostatically charging the surface of a photoconductor to a polarity, typically charging an n-type photoconductor such as zinc oxide to negative polarity, exposing said surface to a film negative containing the image to be reproduced in the form of transparent areas and the non-image part in the form of opaque areas whereby the photoconductor surface becomes discharged in the exposed image areas while retaining the charge in the unexposed non-image areas and applying to said surface toner material having the same polarity as that of the charges contained on said surface, typically applying negative toner material to a negatively charged n-type photoconductor surface, whereby such toner material is repelled from the charged non-image areas onto the discharged image areas forming toner deposits thereon corresponding to the image to be reproduced. The thus formed image deposits in certain instances are fused to the photoconductor surface whereas in other instances they are transferred to a receptor sheet.

Such above described image reversal reproduction by electrophotography is very well suited to microfilm and microfiche reproduction and reader/printers where the information to be reproduced generally is in the form of alphanumeric characters and lines and where complete fill-in of large solid areas and complete absence of fog or stain in the non-image areas are not absolutely required. In pre-press proofing however in order to match the image quality of the press printed sheet it is essential to have on the pre-press proof large solid areas completely filled in and background areas completely free of fog or stain. These requirements can not be met by the prior art electrophotographic reversal process, because unlike by attraction toning, by repulsion toning it is not possible to produce uniformly filled in large solid areas in that toner repulsion from charged background areas onto uncharged solid image areas is most effective near the edges of the solid area where the intensity of the field lines from the charged background area terminating in the uncharged image area is highest and it diminishes in effectiveness towards the center of the solid image area where the intensity of the terminating field lines is lowest. This results in solid image areas characterized by high density near the edges and so-called hollow or lower density center. For the same reason in repulsion toning the background non-image areas are completely free of fog or stain only near the edges. This so-called edge effect can not be fully overcome even by using biasing means during repulsion toning, that is by placing a so-called developing electrode a short distance apart from the photoconductor surface to thereby enhance toner deposition as is well known in the art.

SUMMARY OF THE INVENTION

In accordance with the present invention a multicolor print or pre-press proof is prepared from negative film color separations in essence by uniformly charging a photoconductor to a first polarity, exposing the photoconductor to light through the negative film separation of the first color to thereby discharge the photoconductor in the image areas which are ultimately to be reproduced and which image areas correspond to the transparent areas of the film negative, while retaining the charges on the photoconductor in non-image areas corresponding to the opaque areas of said film negative, forming a uniform color toner layer of a second polarity on a donor member, effecting a virtual contact between said photoconductor and said color toner layer on said donor member to thereby transfer portions of said color toner layer to the photoconductor by attraction to said retained charges thereon while preserving said color toner deposits in the remaining portion thereof and transferring said remaining color toner deposits from said donor member onto a receptor sheet, and affixing the transferred color toner deposits onto said receiving member or printing stock.

The image reversal method of this invention tones by attracting to charges of one polarity color toner of opposite polarity and the residual color toner deposit on the donor member surface constituting the final image on the receptor member or printing stock is formed by electrophoretic deposition, that is attraction to the donor member surface acting as an electrode; because of this feature prints or pre-press proofs produced in accordance with this invention are characterized by having very uniformly filled-in solid areas and completely clean background or non-image areas.

DESCRIPTION OF THE PREFERRED EMBODIMENTS

Figure 1:
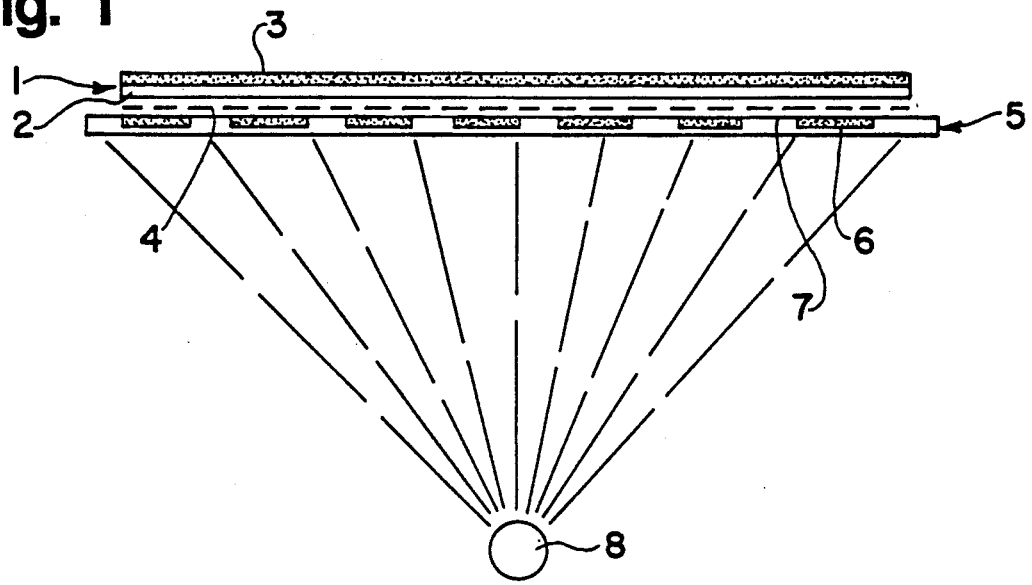
FIG. 1 is a diagrammatic representation illustrating the exposure of a charged photoconductor to a film negative in accordance with the method of the invention.

In FIG. 1 is shown a photoconductive recording member 1 comprising a photoconductive layer 2 on a conductive support 3, uniformly charged to negative polarity as indicated by the negative charges 4. A film negative separation of the first color 5 containing opaque final background or non-image areas 6 and transparent final image areas 7 is placed in contact with photoconductive recording member 1 for contact exposure through light source 8.

Figure 2:
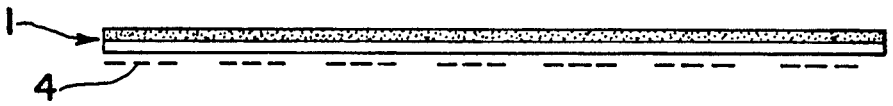
FIG. 2 is a diagrammatic representation of the photoconductor of FIG. 1 illustrating the remaining charges carried thereon after exposure.

In FIG. 2 is illustrated the photoconductive recording member 1 after exposure, having retained negative electrostatic charges 4 only in the areas corresponding to opaque areas of negative film separation 5 of FIG. 1.

Figure 3:
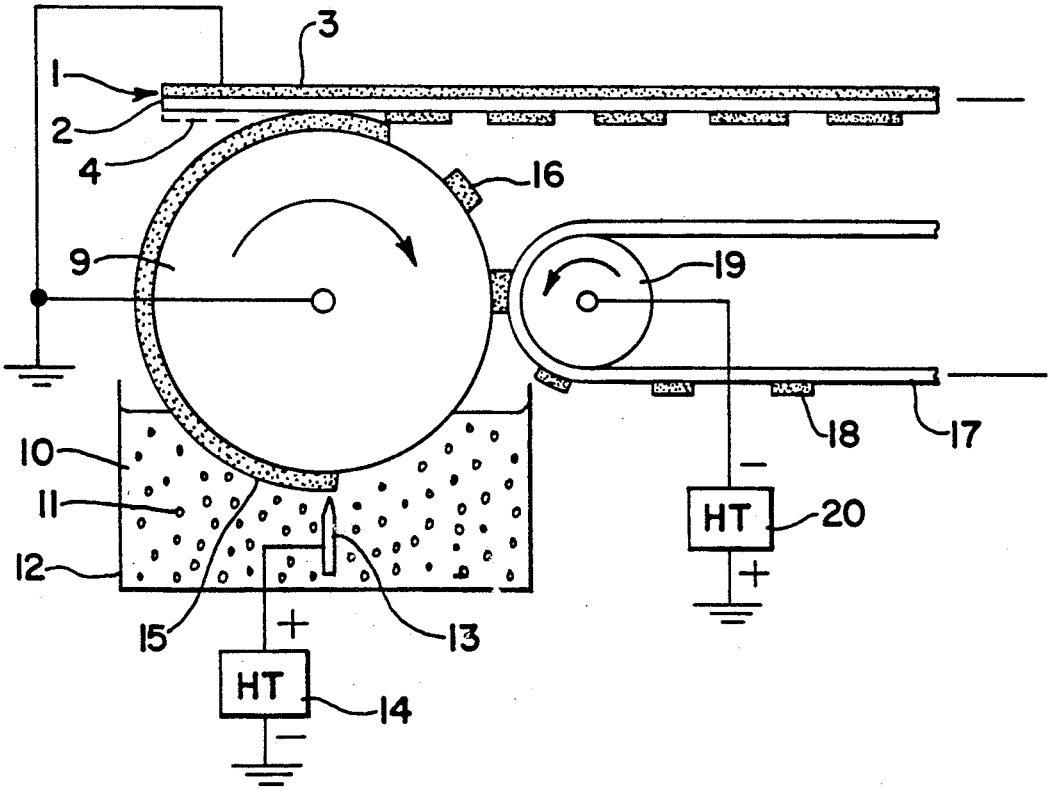
FIG. 3 is a diagrammatic representation of means for toning the photoconductor of FIG. 2 and forming the reverse image on a receptor material according to the method of the invention.

In FIG. 3 is illustrated a donor member 9 comprising for instance a metal cylinder, partially immersed in liquid toner of the first color 10 containing therein suspended positive toner particles 11. The liquid toner 10 is contained within tank 12. An electrode 13, which may be in the shape of a knife-edge, is placed within tank 12 beneath donor member 9 spaced a short distance apart therefrom. Electrode 13 is connected to the positive terminal of power supply 14, the negative terminal of same being grounded. Donor member 9 is also grounded, whereby an electrophoretic cell is formed wherein donor member 9 and electrode 13 constitute the two electrodes of opposite polarity. As donor member 9 is caused to rotate in the direction shown and a voltage from power supply 14 is applied to electrode 13, and electrostatic field is established between donor member 9 and electrode 13, positive toner particles 11 are urged to move electrophoretically towards donor member 9 held at negative ground potential and to deposit thereon in the form of a toner layer of first color 15, which layer remains on donor member 9 as it rotates and emerges from liquid toner 10. Photoconductive recording member 1 is caused to traverse in the direction shown at the same linear speed as the circumferential speed of donor member 9, its photoconductive surface 2 containing after exposure residual negative charges 4 thereon being in virtual contact with rotating donor member 9, its conductive support 3 being grounded. At the point of virtual contact between donor member 9 and photoconductive surface, toner layer 15 is split, in that portion of toner layer 15 contacting the photoconductive surface 2 where electrostatic charges 4 are contained thereon are attracted and transferred thereto whereas those portions of toner layer 15 contacting areas on photoconductive layer 2 which, due to preceding exposure are free of electrostatic charges, remain thereon. As the result of this the remaining portion 16 of toner layer 15 on donor member 9 corresponds to the transparent final image areas 7 of film negative 5 in FIG. 1. The toner deposits forming said remaining portion 16 are electrostatically transferred onto receptor member such as printing stock 17 and the circumferential speed of transfer roll 19 being the same as the circumferential speed of donor member 9. Electrostatic transfer is effected by connecting transfer roll 19 to the negative terminal of power supply 20, the positive terminal of which is grounded. It will be seen that transferred first color toner deposits 18 on printing stock 17 are contained thereon in areas corresponding to the final transparent image areas 7 of first color separation film negative 5 as shown in FIG. 1 and thus a reversal reproduction, that is to say a positive print from a negative film has been produced by toner transfer based on attraction throughout.

To produce a multicolor print or pre-press proof in accordance with this invention the above disclosed steps are repeated in succession with negative film separations of subsequent colors and corresponding color toners. For each subsequent color the receptor member or printing stock carrying thereon the preceding color toner deposits is moved around the transfer roll in register with the donor member to ensure that all color images are transferred to the printing stock in exact register with each other. For the same purpose, as will be obvious to those skilled in the art, the color separation film negatives are placed in register with the photoconductive recording member during contact exposure, and as the photoconductive member traverses the donor member for transfer toning, registration means are provided to ensure exact coincidence between corresponding image areas on the photoconductive surface and the donor member surface.

It should be noted that for illustrative purposes in the foregoing, reference was made to charging the photoconductive member to negative polarity, that is to the use of an n-type photoconductor, followed by transfer toning same by attraction thereto of positive color toner. It is equally possible to employ a p-type photoconductor which can be charged positively and toned by attraction thereto of negative color toner. It will be realized of course that in those instances where a negative color toner is transferred from the donor member onto the photoconductive member and a negative color toner deposit is transferred from the donor member onto the receiving member, the polarity of the electrode causing toner layer formation on the donor member will be negative and grounding polarity positive while transfer roll polarity will be positive and transfer power supply grounding negative.

It should be further noted that in the foregoing electrostatic transfer from the donor member onto the printing stock has been illustrated by means of a roll comprising for instance a conductive core connected to the terminal of the power supply and a cover layer of semiconductive elastomer, as is well known in the art, however other well known means for electrostatic transfer such as a corona generator can be employed equally well to serve the same purpose. Furthermore, transfer of color toner deposits from the donor member onto the receiving member may be effected by methods other than electrostatic, such as for instance by pressure, adhesion, heat and/or embedment in a receptor coating on the receiving member.

While in the foregoing the photoconductive member has been illustrated as a flat plate and the donor member as a cylinder, it should be realized that the photoconductive member may be cylindrical and the donor member flat, or both members can be flat or cylindrical, or either or both members can be in the form of belts, if so desired. In like manner the receptor member instead of being a flexible paper sheet as illustrated can comprise a rigid material such as cardboard or metal plate, in which case of course appropriate re-arrangement of the transfer from the donor to the receptor member will be required, as would be obvious to those skilled in the art.

Although in the foregoing illustrations both the conductive support of the photoconductive member and the donor member were shown to be at ground potential or of equal polarity during transfer toning, it may be found desirable in certain instances to apply a bias voltage between the two members to enhance toning or image quality, as is well known in the art.

The embodiment as illustrated in FIG. 3 comprises only the essential elements of the present invention, and it should be realized that in practice it may be desirable to incorporate other elements as are commonly used in electrostatographic equipment for improving performance and/or image quality, such as for instance a doctor blade or corona generator means to control the quantity of carrier liquid over the toner layer formed on the donor member, means to wet the photoconductor surface with carrier liquid type solvent before and/or after transfer toning, cleaning means to remove toner layer portions from the photoconductive surface preparatory to charging for a following color, means to wet with carrier liquid type solvent the donor member and/or the receptor member prior to toner deposit transfer, and the like.

An important feature of this invention consists in the capability to precisely predetermine the thickness of the toner layer formed on the donor member as a function of the electrophoretic mobility of specific toners, toner concentration, the gap between electrode and donor member, electrode voltage and speed of rotation of donor member. As the toner deposits forming the portions of the toner layer remaining on the donor member after transfer toning the photoconductor are virtually completely transferred to the receptor member and as the optical densities of such transferred toner deposits on the receptor member are therefore directly related to the thickness of the toner layer formed on the donor member by the electrode, it is readily possible in accordance with this invention to produce multicolor prints or pre-press proofs wherein image deposits of specific colors have specific optical densities precisely as desired by predetermining the toner layer thickness on the donor member as above described.

Color toners usable in the process of the present invention may be for example as disclosed in U.S. Pat. No. 3,998,746 of Tsuneda, U.S. Pat. No. 3,820,986 of Fukashima et al., and U.S. Pat. No. 3,419,411 of Wright.

There has been described a novel electrostatographic method of reversal reproduction, that is, of producing positive imagery from film negatives. The method employs attraction development throughout with liquid toners, hence image quality is excellent, and the method is particularly suitable for the production of multicolor pre-press proofs on printing stock. And additional feature of the method consists in the capability of predetermining exactly as required the optical density of each color image deposit on the final pre-press proof or print. Equipment configurations, materials and proportioning of materials as disclosed herein are intended to be construed in illustrative sense only without restricting the scope of this invention.

What is claimed is:

1. The method of electrostatographic image reversal wherein a positive print comprising a receptor sheet having image-free areas and image areas formed by color toner deposits is produced from a negative film having opaque areas corresponding to said image-free areas on said print and transparent areas corresponding to said image areas on said print, said method comprising the essential steps of;

A. electrostatically charging a photoconductor to deposit thereon uniformly charges of a first polarity;

B. exposing said photoconductor to light through a negative film thereby to discharge said photoconductor in the areas corresponding to said transparent areas of said negative film while retaining said charges theron in areas corresponding to said opaque areas of said negative film;

C. forming a uniform color toner layer of a second polarity on a donor member by electrophoretic deposition;

D. effecting a virtual contact between said photoconductor and said color toner layer on said donor member to thereby transfer portions of said color toner layer to said photoconductor by attraction to said retained charges thereon while preserving said color toner layer on said donor member in the form of color toner deposits in the remaining portion thereof;

E. transferring said color toner deposits from said donor member onto a receptor sheet; and F. affixing said color toner deposits to said receptor sheet.

2. The method of electrostatographic image reversal according to claims 1 in which the second polarity is opposite the polarity of the charges deposited on the photoconductor.

3. The method of electrostatographic image reversal according to claims 1, wherein said uniform color toner layer on said donor member is formed by electrophoretic deposition to be of predetermined thickness.

4. The method of electrostatographic image reversal according to claims 1, wherein the optical density of said colored toner deposits on said receptor sheets transferred thereto from said donor member is controlled by the thickness of said uniform color toner layer formed on said donor member.

5. The method of electrostatographic image reversal according to claims 1, wherein said photoconductor is contained on a conductive support and wherein said conductive support and said donor member are electrically connected while said photoconductor is contacted with said color toner layer on said donor member to thereby transfer portion of said color toner layer to said photoconductor.

6. The method of electrostatographic image reversal according to claims 1, wherein said photoconductor is contained on a conductive support and wherein said conductive support and said donor member are held at different voltage potentials in relation to each other while said photoconductor is contacted with said color toner layer on said donor member to thereby transfer portion of said color toner layer to said photoconductor.

7. The method of electrostatographic image reversal according to claims 1, wherein said color toner deposits are electrostatically transferred from said donor member to said receptor sheet.

8. The method of electrostatographic image reversal as in claim 1 wherein plural negative separation films of subsequent colors and appropriate color toners are used sequentially to produce a multicolor print comprising said receptor sheet having image-free areas and image areas formed by multiple color toner deposits in register with each other, the steps of transferring said toner layer and said color toner deposits respectively being effected in register and the color toner deposits are affixed to said receptor sheet subsequent to the last to be applied deposit, the steps A–F being repeated with the said negative separation films and the appropriate color toners.

9. The method of electrostatographic image reversal according to claim 8 in which the portions of the first color toner layer transferred to the photoconductor are removed therefrom before the next to be applied color toner layer is applied.

10. The method of electrostatographic image reversal wherein a positive mulitcolor print comprising a receptor sheet having image-free areas and image areas formed by multiple color toner deposits is produced from negative color separation films having opaque areas corresponding to said image-free areas of said print and transparent areas corresponding to said image areas of said print, said method comprising the essential steps of;

A. electrostatically charging a photoconductor to deposit thereon uniformly charges of a first polarity;

B. exposing said photoconductor to light through and in register with a negative separation film of a first color to thereby discharge said photoconductor in the areas corresponding to said transparent areas of said negative separation film of a first color while retaining said charges thereon in areas corresponding to the opaque areas of said negative separation film of the first color;

C. forming a uniform first color toner layer of second polarity on a donor member by electrophoretic deposition;

D. effecting a virtual contact between said photoconductor in register with said donor member with said first color toner layer on said donor member to thereby transfer portion of said first color toner layer to said photoconductor by attraction to said retained charges thereon while preserving said first color toner layer on said donor member in the form of first color toner deposits in the remaining portion thereof;

E. transferring in register said first color toner deposits from said donor member onto a receptor sheet;

F. removing from said photoconductor said portion of said first color toner layer transferred thereto;

G. repeating above steps A to F with negative separation films of subsequent colors and appropriate subsequent color toners to produce a multicolor print comprising said receptor sheet having image-free areas and image areas formed by multiple color toner deposits in register with each other; and H. affixing said color toner deposits to said receptor sheet.

* * * * *

UNITED STATES PATENT AND TRADEMARK OFFICE

CERTIFICATE OF CORRECTION

PATENT NO. : 5,030,530

DATED : July 9, 1991

INVENTOR(S) : Josef Matkan

It is certified that error appears in the above-identified patent and that said Letters Patent is hereby corrected as shown below:

Column 1, line 14, after therefrom add --.--;

Claim 2, line 2, change "claims" to --claim--;

Claim 3, line 2, change "claims" to --claim--;

Claim 4, line 2, change "claims" to --claim--;

Claim 5, line 2, change "claims" to --claim--;

Claim 6, line 2, change "claims" to --claim--;

Claim 7, line 2, change "claims" to --claim--;

Signed and Sealed this

Seventeenth Day of March, 1992

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 5,030,530

DATED : July 9, 1991

INVENTOR(S) : Josef Matkan

It is certified that error appears in the above-identified patent and that said Letters Patent is hereby corrected as shown below:

Cover page, after item [21], insert item

-- [73] Assignee: Stork Colorproofing B.V.
Utrecht, the Netherlands --

Column 1, line 14, after therefrom add --.--;

Claim 2, line 2, change "claims" to --claim--;

Claim 3, line 2, change "claims" to --claim--;

Claim 4, line 2, change "claims" to --claim--;

Claim 5, line 2, change "claims" to --claim--;

Claim 6, line 2, change "claims" to --claim--;

Claim 7, line 2, change "claims" to --claim--;

This certificate supersedes Certificate of Correction issued March 17, 1992.

Signed and Sealed this

Twelfth Day of May, 1992

*Attest:*

DOUGLAS B. COMER

*Attesting Officer*

*Acting Commissioner of Patents and Trademarks*